US005813776A

United States Patent [19]

Fujiwara et al.

[11] Patent Number: 5,813,776

[45] Date of Patent: Sep. 29, 1998

[54] PRINTING METHOD AND PRINTING APPARATUS USING SPLIT SEAL PAPER SHEETS

[75] Inventors: Susumu Fujiwara; Toshiyuki Watanabe, both of Gifu; Yoshiaki Ishikawa; Mikio Ichihashi, both of Hashima; Shigeki Shibuya; Nobuo Iwatsuki, both of Gifu, all of Japan

[73] Assignee: Sanyo Electric Co., Ltd., Osaka-fu, Japan

[21] Appl. No.: 964,830

[22] Filed: Nov. 5, 1997

[30] Foreign Application Priority Data

Nov. 14, 1996 [JP] Japan ..... 8-302646
Feb. 12, 1997 [JP] Japan ..... 9-027965

[51] Int. Cl.[6] ..... B41J 21/16

[52] U.S. Cl. ..... 400/279; 400/76; 400/582; 40/37

[58] Field of Search ..... 400/279, 582, 400/322, 323, 76, 555; 40/37, 40

[56] References Cited

U.S. PATENT DOCUMENTS 4,618,275 10/1986 Brinkmann et al. ..... 400/76
4,818,129 4/1989 Tanuma et al. ..... 400/323
4,891,771 1/1990 Edel et al. ..... 400/76
5,349,375 9/1994 Bolash et al. ..... 347/40
5,458,424 10/1995 Kato et al. ..... 400/279
5,486,055 1/1996 Oka ..... 406/61
5,511,890 4/1996 Momose ..... 400/323
5,520,469 5/1996 Owa ..... 400/76
5,599,114 2/1997 Sugahara et al. ..... 400/279
5,603,578 2/1997 Furuya ..... 400/279
5,609,426 3/1997 Ito et al. ..... 400/279
5,645,359 7/1997 Goto et al. ..... 400/323
5,683,188 11/1997 Miyazak et al. ..... 400/279

*Primary Examiner*—Eugene H. Eickholt
*Attorney, Agent, or Firm*—Nikaido, Marmelstein, Murray & Oram LLP

[57] ABSTRACT

A split seal paper sheet in which the width of split seals composing the split seal paper sheet in the direction of conveyance of the paper sheet is smaller than the print width of a serial head is used. One or more of the split seals is/are positioned in one scanning region of the serial head, to print an image on the split seals. Line feed for printing on one or more split seals in the subsequent line is performed in such a manner that the line feed width is the same as the print width of the serial head. Consequently, the entire image is formed on one split seal without conveying the paper sheet (performing line feed). Even if a pitch between lines becomes non-uniform in conveyance of the paper sheet, the image on the split seal is not degraded.

16 Claims, 13 Drawing Sheets

PRINTING METHOD AND PRINTING APPARATUS USING SPLIT SEAL PAPER SHEETS

BACKGROUND OF THE INVENTION

1. Field of the Invention

The present invention relates to a method of and an apparatus for printing, using a split seal paper sheet, an image on one or more split seals composing the split seal paper sheet by a serial head.

2. Description of the Prior Art

FIGS. 1 and 2 are perspective views showing a principal part of a general serial head type recorder. The serial head type recorder comprises a paper conveying roller section 1 comprising a conveying roller 1*a* for conveying a paper sheet 10 (see FIG. 3 because it is not illustrated in FIGS. 1 and 2) and a pinch roller 1*b* provided in an arrangement opposite to the conveying roller 1*a* for holding the paper sheet between the conveying roller 1*a* and the pinch roller 1*b*, a platen 2 arranged in the vicinity of the paper conveying roller section 1, a driving pulse motor (not shown) rotated through a predetermined angle in response to pulses, a group of gears 3 for transmitting torque produced by the pulse motor to the conveying roller 1*a*, a serial head 4 of a thermal type, for example (see FIG. 3 because it is not illustrated in FIGS. 1 and 2) for doing printing on the paper sheet 10, a carriage 5 on which a head supporting member 15 for supporting the serial head 4 is mounted, an ink ribbon cassette 6 set in the carriage 5, a shaft 7 for guiding the carriage 5 along the breadth of the paper sheet, and a paper feeding plate 12 on which the paper sheet is put.

FIG. 3 is an explanatory view showing a general printing mechanism. The paper sheet 10 is positioned between the serial head 4 and the platen 2. An ink ribbon 6*a* of the ink ribbon cassette 6 is interposed between the paper sheet 10 and the serial head 4. The serial head 4 and the ink ribbon cassette 6 are moved leftward in FIG. 3 (in the carriage scanning direction), and the ink ribbon 6*a* is delivered from a feeding roll 6*b* and is wound around a winding roll 6*c*. When one line is printed, the conveying roller 1*a* is driven, so that the paper sheet 10 is moved by the line feed width (that is, line feed is performed).

A color printing apparatus can be constructed by preparing ink ribbons in colors, that is, yellow (Y), magenta (M), and cyan (C) or preparing an ink ribbon coated with colors, that is, yellow (Y), magenta (M), and cyan (C) in this order and using the serial head. The formation of a color image in such a color printing apparatus can be realized by first printing one scanning recording line using the ink ribbon in yellow (Y), then printing over the scanning recording line a scanning recording line using the ink ribbon in magenta (M), and further printing over the scanning recording line a scanning recording line using the ink ribbon in cyan (C), to form one color scanning recording line, and repeating the printing of the color scanning recording line.

In the serial head type recorder, non-uniformity in a pitch between printed lines is a problem. For example, when the amount of conveyance of the paper sheet 10 is larger than the print width of the serial head 4, for example, a clearance occurs between the lines, as shown in FIG. 9. If the amount of conveyance is smaller than the print width, the lines are undesirably overlapped with each other, so that the density is increased only in a portion where the lines are overlapped with each other, and an image is degraded because dots do not coincide with each other. FIG. 9 is a schematic view. An ink layer as shown is not seen in a sublimation type printing apparatus.

Although the above-mentioned non-uniformity in a pitch between lines is caused by non-uniformity in conveyance of the paper sheet in a recording paper conveying system, it is difficult to completely remove the non-uniformity in conveyance. The degradation of the image due to the non-uniformity in the pitch between lines similarly occurs in not only printing using the above-mentioned general paper sheet but also printing using a split seal paper sheet as the paper sheet.

The split seal paper sheet is one so adapted that a plurality of split seals in various shapes are stripped from a layout sheet. A picture of a person or the like read by a scanner, for example, is printed on the split seals upon being subjected to predetermined reduction processing. The split seals on which the picture of a person, for example, is printed can be stripped from the layout sheet and affixed to a notebook, for example. In a case where such a split seal paper sheet is used, as shown in FIG. 10 for example, the degradation of the image occurs due to the clearance between lines and the overlapping of the lines when one split seal 120 is completed by printing of two lines.

The present invention has been made in view of the above-mentioned circumstances and has for its object to provide a printing method and a printing apparatus using a split seal paper sheet in which an image on split seals composing the split seal paper sheet is not degraded even if a pitch between lines becomes non-uniform.

SUMMARY OF THE INVENTION

A printing method using a split seal paper sheet according to the present invention is characterized in that a split seal paper sheet in which the width of split seals composing the split seal paper sheet in the direction of conveyance of the paper sheet is smaller than the print width of a serial head is used, one or more of the split seals is/are positioned in one scanning region of the serial head, to print an image on the split seals, and line feed for printing on one or more split seals in the subsequent line is performed in such a manner that the line feed width is the same as or larger than the print width of the serial head.

A printing apparatus using a split seal paper sheet according to the present invention is characterized by comprising a paper conveying roller section for conveying a paper sheet, line feed width control means for controlling the amount of feed of the paper sheet by the paper conveying roller section, and a serial head for doing printing on the paper sheet, wherein in a case where a split seal paper sheet in which the width of split seals composing the split seal paper sheet in the direction of conveyance of the paper sheet is smaller than the print width of the serial head is used as the paper sheet, one or more of the split seals is/are positioned in one scanning region of the serial head, to print an image on the split seals, and the line feed width control means performs line feed for printing on one or more split seals in the subsequent line in such a manner that the line feed width is the same as or larger than the print width of the serial head.

In such construction, the entire image on one split seal can be formed without conveying the paper sheet (performing line feed). Even if a pitch between lines becomes non-uniform in conveyance of the paper sheet, an image on the split seal is not degraded.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

(Embodiment 1)

An embodiment of the present invention will be described on the basis of drawings. For convenience of illustration, FIGS. 1 to 3 used in the conventional example are used again.

Figure 1:
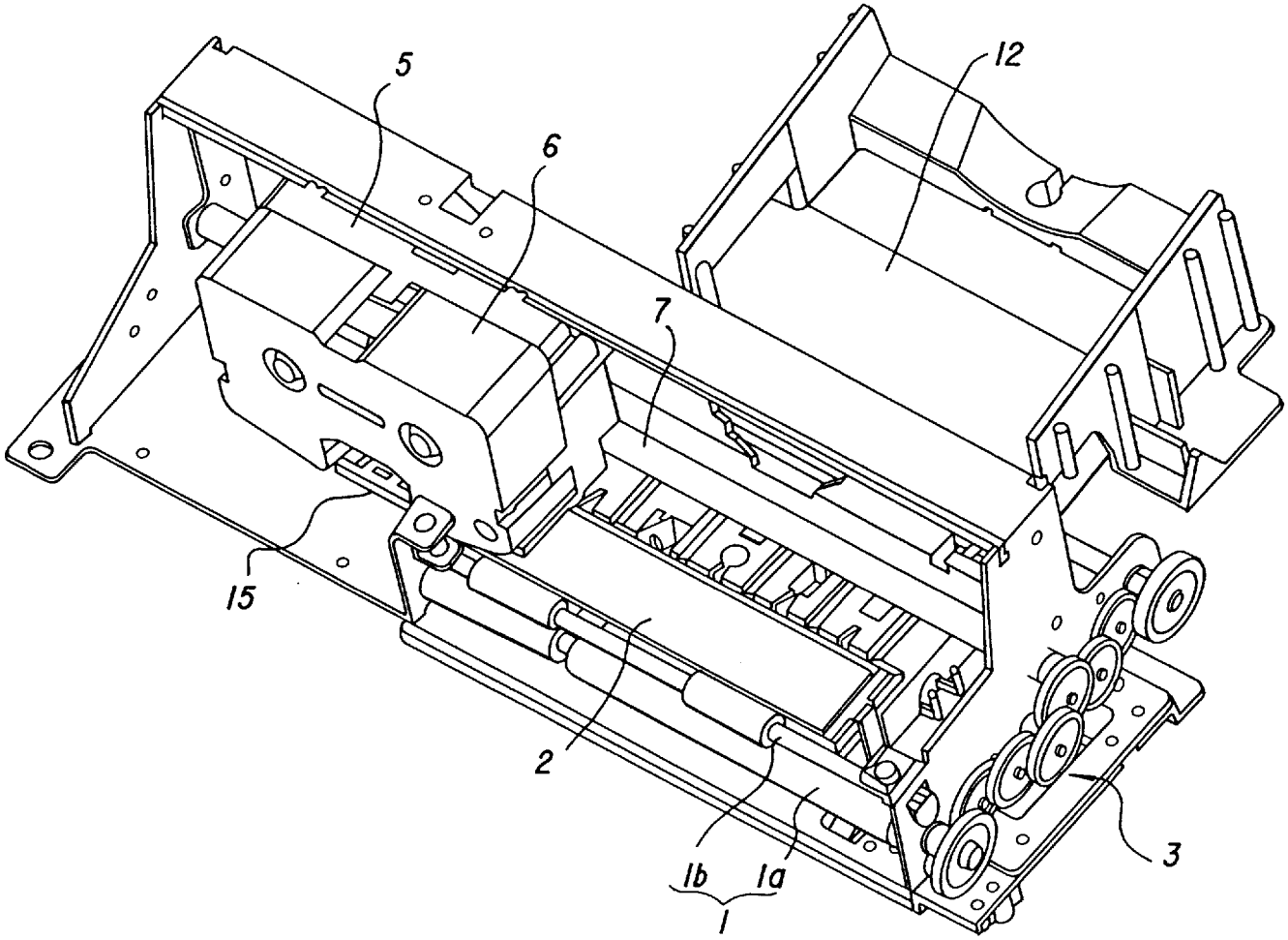
FIG. 1 is a perspective view showing a paper sheet conveying system and a serial head scanning system in a general serial head type recorder.
Figure 2:
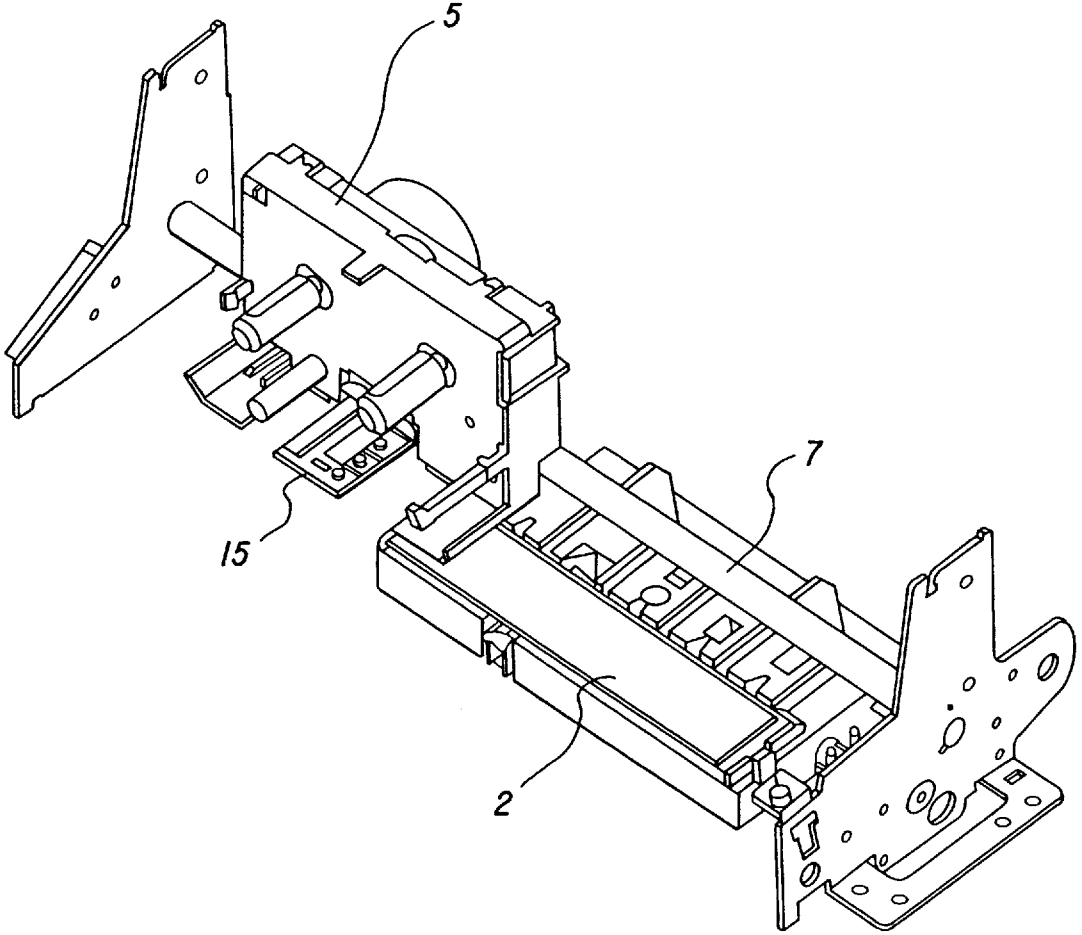
FIG. 2 is a perspective view in which an ink ribbon cassette, a paper feeding plate and the like are removed in FIG. 1.

FIGS. 1 and 2 are perspective views showing a principal part of a general serial head type recorder. The serial head type recorder comprises a paper conveying roller section 1 comprising a conveying roller 1*a* for conveying a paper sheet 10 (see FIG. 3 because it is not illustrated in FIGS. 1 and 2) and a pinch roller 1*b* provided in an arrangement opposite to the conveying roller 1*a* for holding the paper sheet between the conveying roller 1*a* and the pinch roller 1*b*, a platen 2 arranged in the vicinity of the paper conveying roller section 1, a driving pulse motor (not shown) rotated through a predetermined angle in response to pulses, a group of gears 3 for transmitting torque produced by the pulse motor to the conveying roller 1*a*, a serial head 4 of a thermal type, for example (see FIG. 3 because it is not illustrated in FIGS. 1 and 2) for doing printing on the paper sheet 10, a carriage 5 on which a head supporting member 15 for supporting the serial head 4 is mounted, an ink ribbon cassette 6 set in the carriage 5, a shaft 7 for guiding the carriage 5 along the breadth of the paper sheet 10, and a paper feeding plate 12 on which the paper sheet 10 is put.

Figure 3:
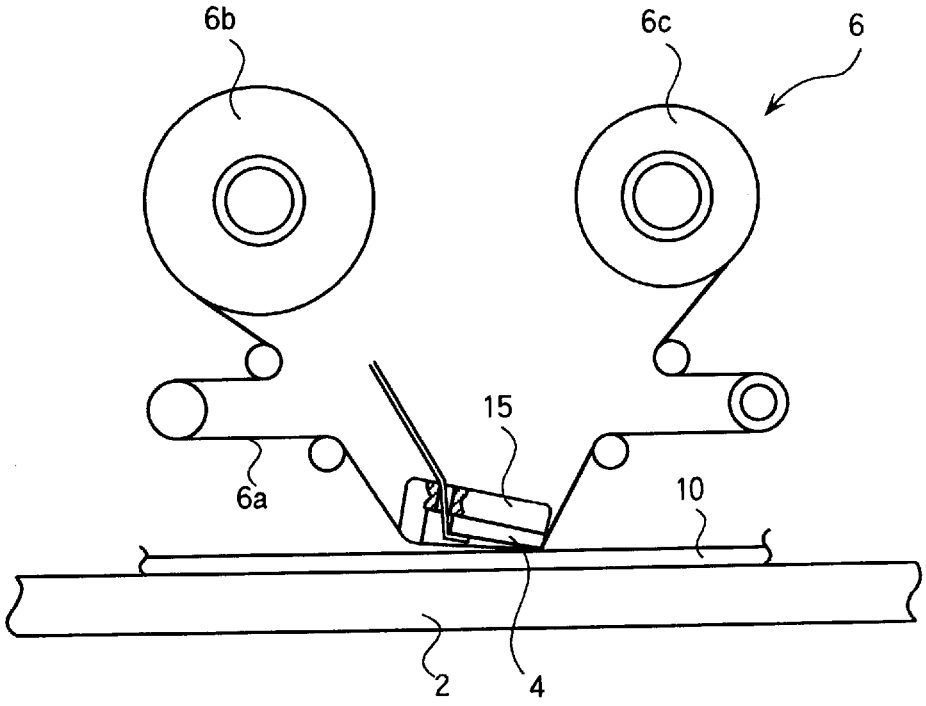
FIG. 3 is an explanatory view showing a general printing mechanism.

FIG. 3 is an explanatory view showing a general printing mechanism. The paper sheet 10 is positioned between the serial head 4 and the platen 2. An ink ribbon 6*a* of the ink ribbon cassette 6 is interposed between the paper sheet 10 and the serial head 4. The serial head 4 and the ink ribbon cassette 6 are moved leftward in FIG. 3 (in the carriage scanning direction), and the ink ribbon 6*a* is delivered from a feeding roll 6*b* and is wound around a winding roll 6*c*. When one line is printed, the conveying roller 1*a* is driven, so that the paper sheet 10 is moved (that is, line feed is performed).

Figure 4:
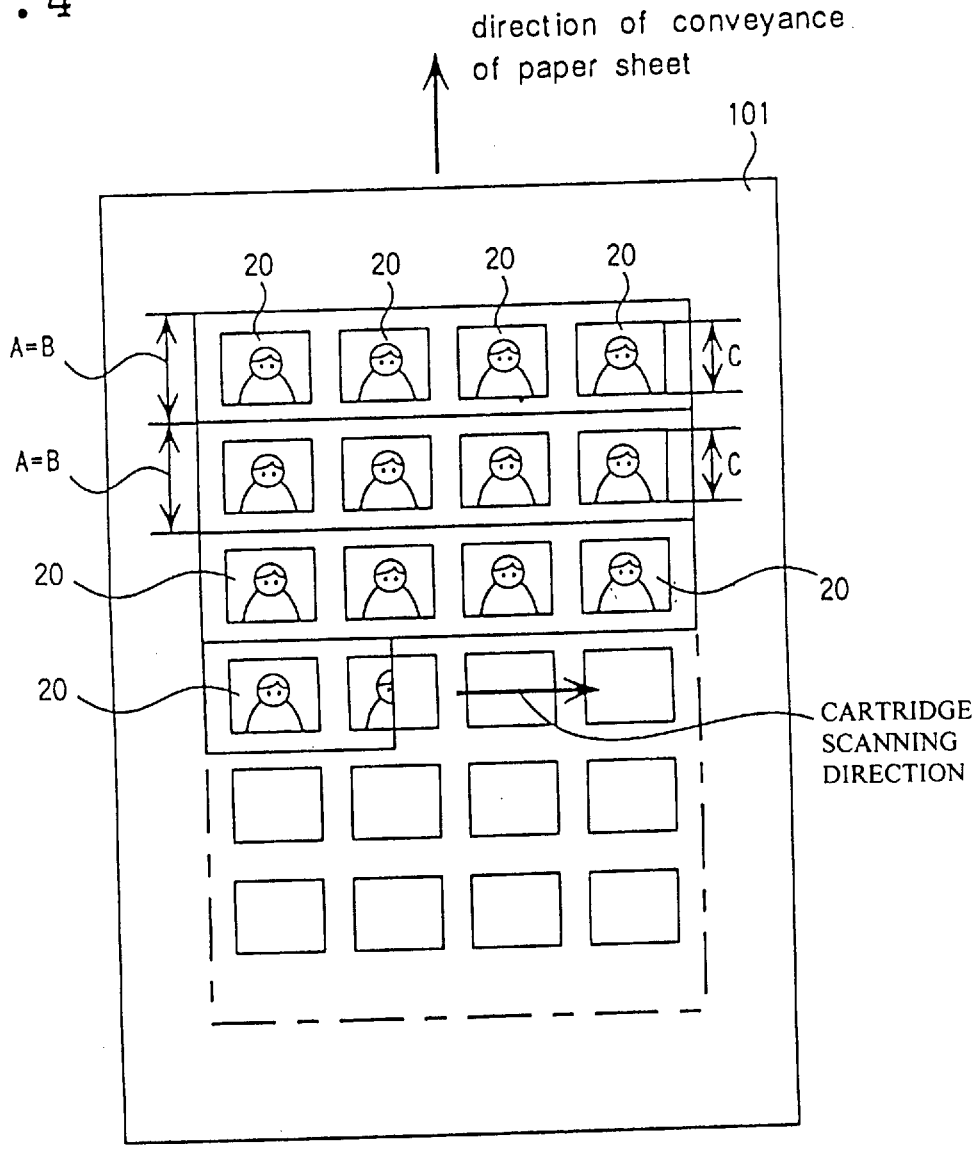
FIG. 4 is a diagram showing the present invention, which illustrates one example of the relationship among the line feed width of a split seal paper sheet, the print width, and the width of split seals composing the split seal paper sheet in the direction of conveyance of the paper sheet.
Figure 5:
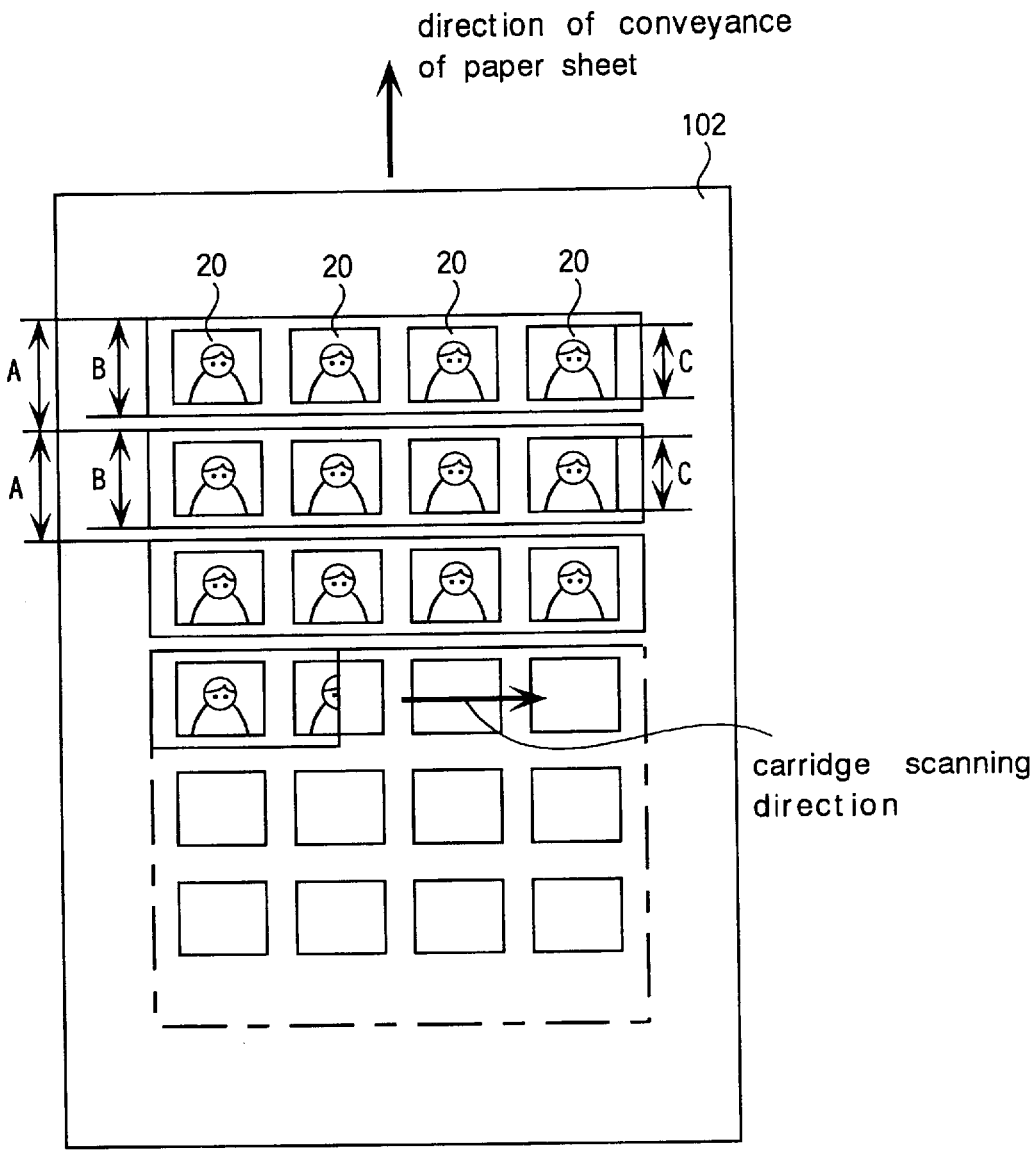
FIG. 5 is a diagram showing the present invention, which illustrates another example of the relationship among the line feed width of a split seal paper sheet, the print width, and the width of split seals composing the split seal paper sheet in the direction of conveyance of the paper sheet.
Figure 6:
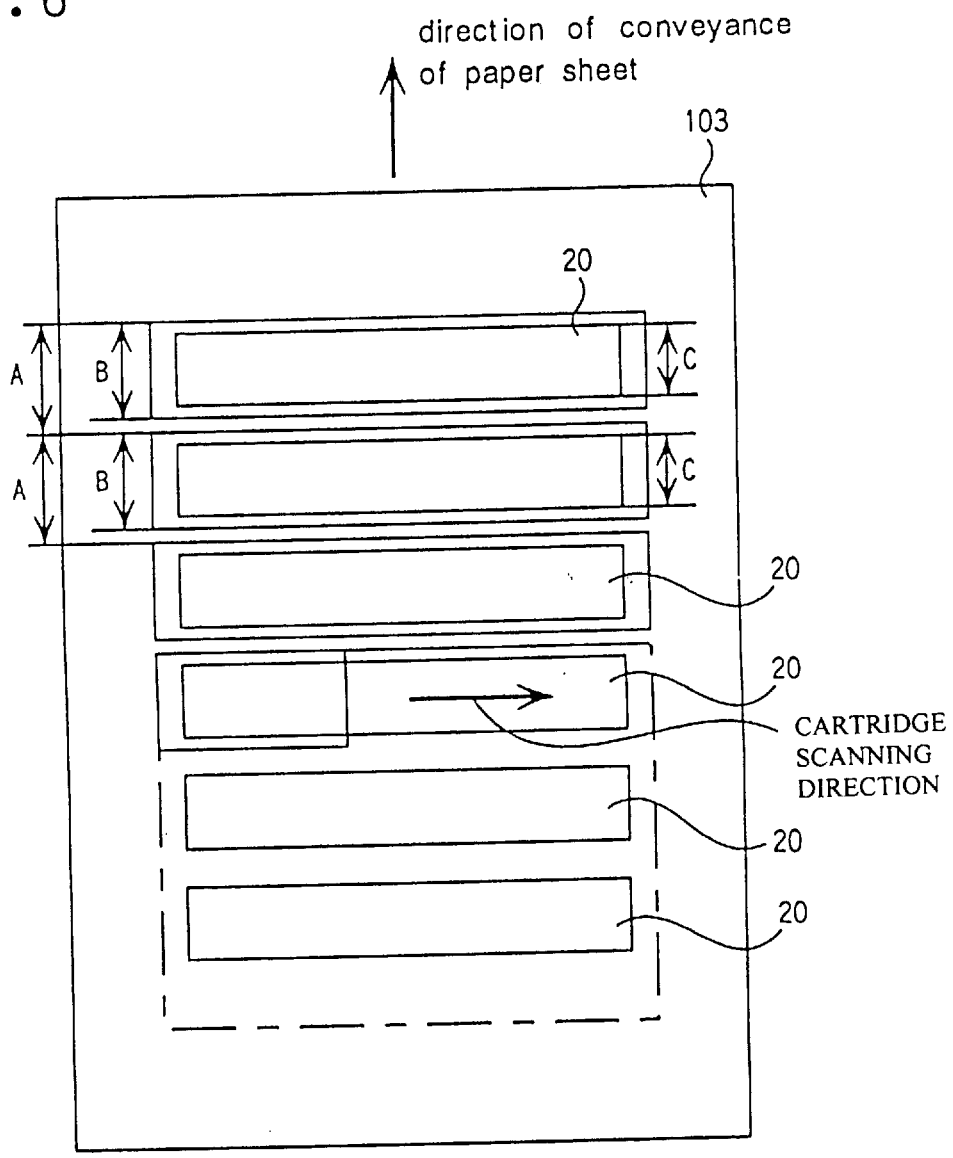
FIG. 6 is a diagram showing the present invention, which illustrates still another example of the relationship among the line feed width of a split seal paper sheet, the print width, and the width of split seals composing the split seal paper sheet in the direction of conveyance of the paper sheet.

FIGS. 4, 5 and 6 are diagrams respectively showing the relationships among the line feed widths A of split seal paper sheets 101, 102, and 103, the print width B of the serial head 4, and the width C of split seals 20 composing the split seal paper sheet in the direction of conveyance of the paper sheet.

In the form shown in FIG. 4, the line feed width A and the print width B coincide with each other. The width C of the split seals 20 in the direction of conveyance of the paper sheet is made smaller than the print width B. Further, four split seals 20 provided in the transverse direction are positioned in one scanning region of the serial head 4.

In the form shown in FIG. 5, the line feed width A is larger than the print width B. The width C of the seals 20 in the direction of conveyance of the paper sheet is smaller than the print width B. Further, four split seals 20 provided in the transverse direction are positioned in one scanning region of the serial head 4.

In the form shown in FIG. 6, the line feed width A is larger than the print width B. The width C of the split seals 20 in the direction of conveyance of the paper sheet is smaller than the print width B. Further, one oblong split seal 20 is positioned in one scanning region of the serial head 4.

The width of a plate-shaped platen 2 in the direction of conveyance of the paper sheet is approximately the same as the print width B of the serial head 4, and is larger than the width C of the split seals 20 in the direction of conveyance of the paper sheet, which is not illustrated in the drawings.

Figure 7:
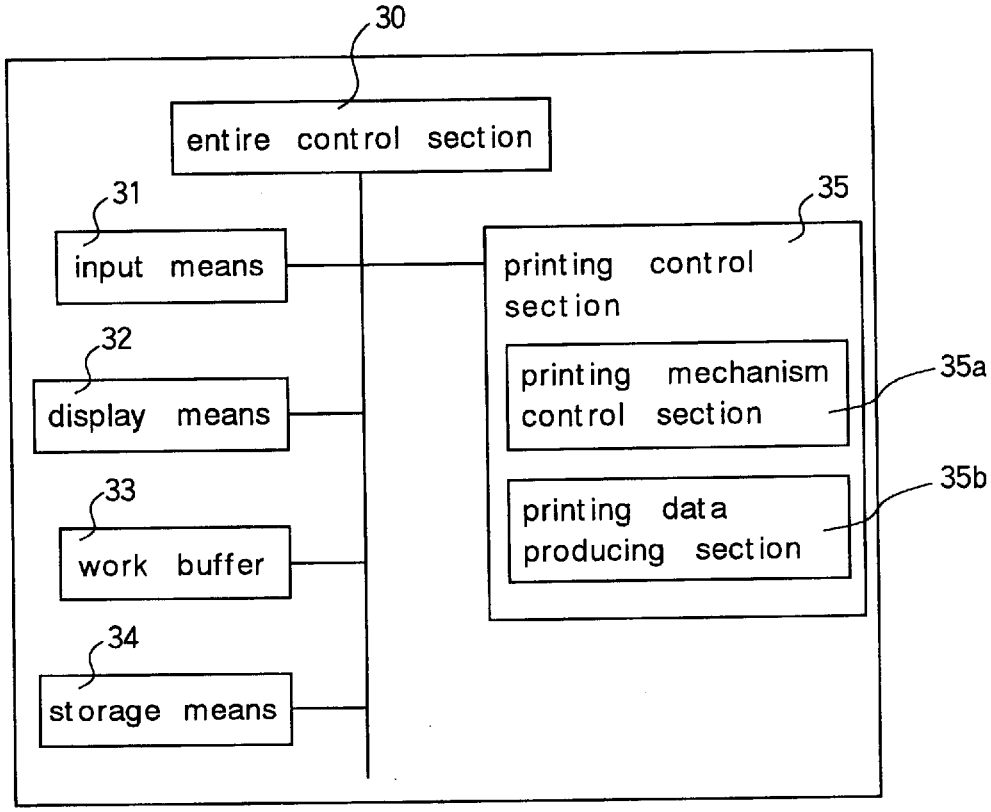
FIG. 7 is a block diagram showing the schematic construction of an electric system of a printing apparatus according to the present invention.

FIG. 7 is a block diagram showing the schematic construction of an electric system of a printing apparatus according to an embodiment of the present invention. An entire control section 30 carries out entire control of respective sections such as input means 31, display means 32, or a printing control section 35 as described later.

The input means 31 comprises a key board and a mouse for data entry (not shown), and an image reader, a CCD camera and the like (not shown) for image entry, which can enter a set value in setting of printing or the like, enter various operation commands, and enter image data such as an image and a text. The display means 32 comprises a CRT, a liquid crystal display panel, and the like (not shown), on which the commands entered by the input means 31, various messages such as an error message, an image to be printed, and the like are displayed. A work buffer 33 expands various data in order to produce (edit) the image data to be printed.

Storage means 34 comprises a hard disk, for example, for filing and storing the produced image data.

The printing control section 35 comprises a printing mechanism control section 35*a* and a printing data producing section 35*b*. The printing mechanism control section 35*a* carries out control of movement of the carriage for scanning the serial head 4, control of the head supporting member 15 for pressing/separation of the paper sheet, control of conveyance of the paper sheet by the paper conveying roller section 1, control of driving of the paper feeding roller, and the like. In the control of conveyance of the paper sheet (that is, control of line feed of the paper sheet), when printing in the above-mentioned form shown in FIG. 4 is done, the paper sheet is conveyed in such a manner that the line feed width A coincides with the print width B of the serial head 4. When printing in the above-mentioned form shown in FIGS. 5 and 6 is done, the paper sheet is conveyed in such a manner that the line feed width A is larger than the print width B of the serial head 4. The setting of the amount of conveyance of the paper sheet (the setting of the number of pulses fed to the driving pulse motor) is performed by paper setting and mode setting (a mode of line feed width A=print width B, a mode of line feed width A>print width B) depending on user setting using the input means 31. Further, the printing data producing section 35*b* produces data (printing data) to be fed to the serial head 4 on the basis of the image data and information representing density setting.

The electric circuit arrangement, together with a printing mechanism, can be also constructed for amusement, for example, by being contained in one case, or can be constructed for personal use by being combined with a personal computer and its peripheral equipments.

Figure 8:
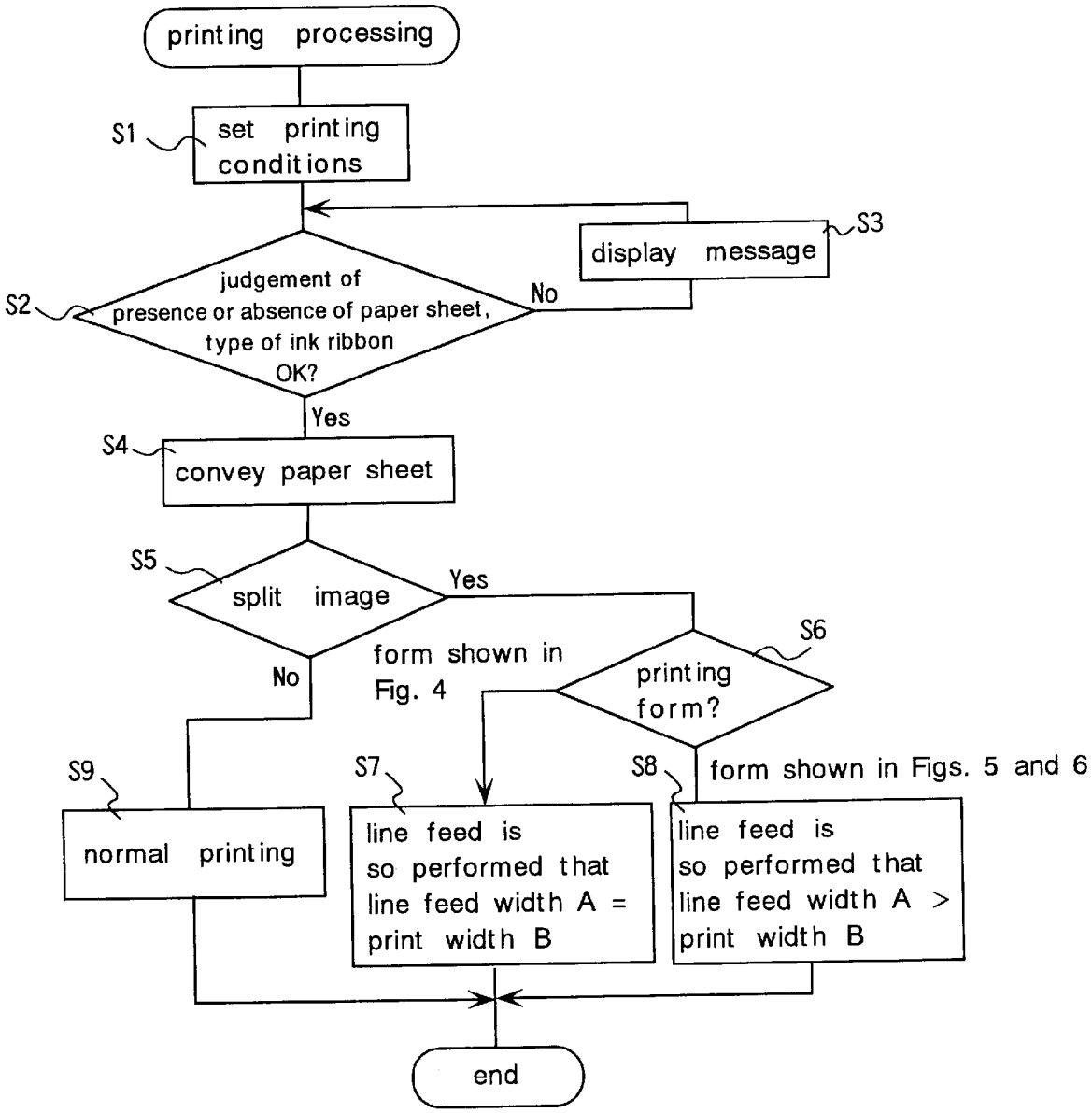
FIG. 8 is a flow chart showing the contents of printing processing of the printing apparatus according to the present invention.
Figure 9:
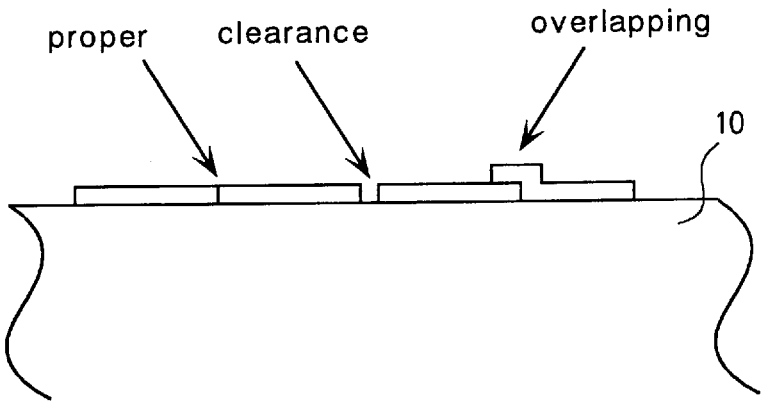
FIG. 9 is an explanatory view showing overlapping of lines and a clearance between the lines due to non-uniformity in conveyance of a paper sheet.
Figure 10:
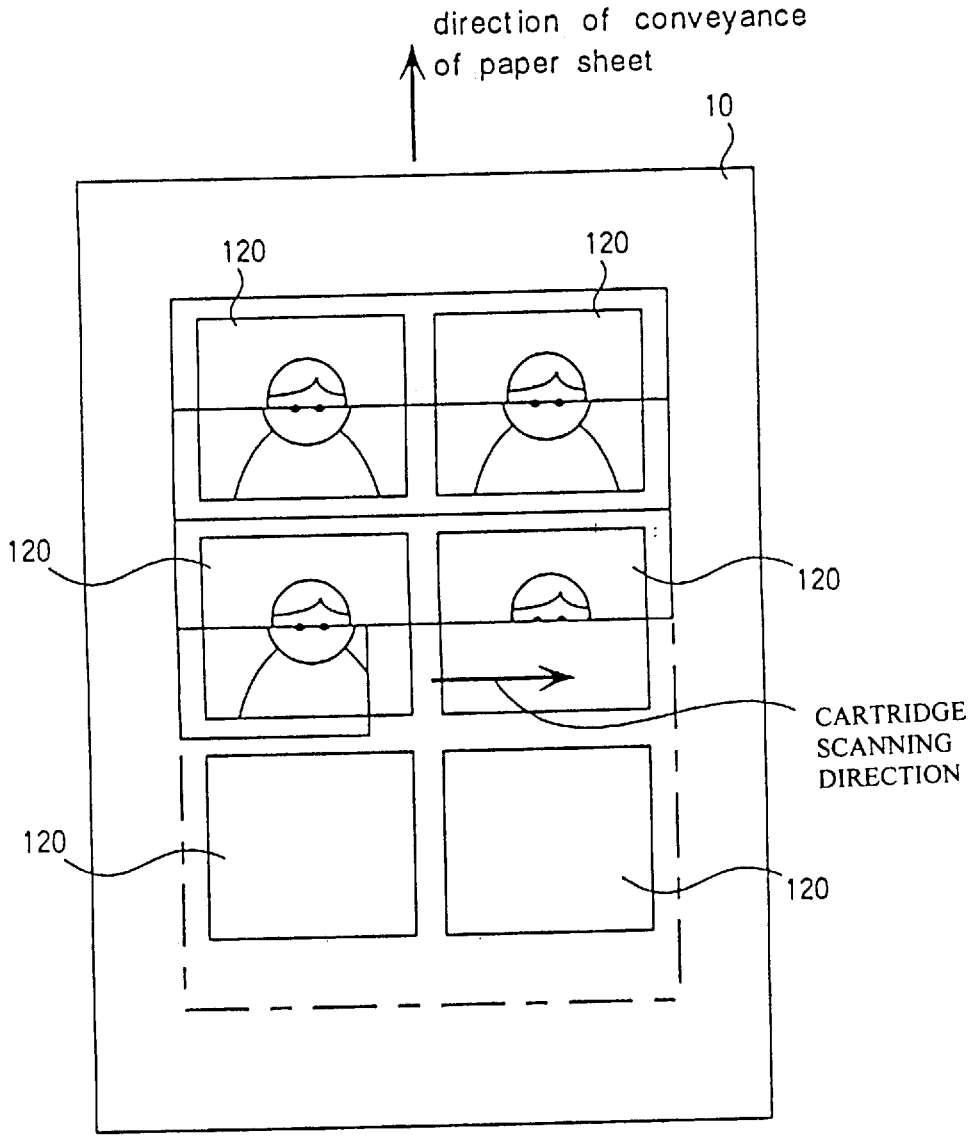
FIG. 10 is a diagram showing the relationship among the line feed width of a split seal paper sheet, the print width, and the width of split seals composing the split seal paper sheet in the direction of conveyance of the paper sheet in a conventional example.

FIG. 8 is a flow chart showing the contents of control in the above-mentioned printing apparatus. Printing conditions are first set (step 1). Examples of the printing conditions include selection of image data, selection of a paper sheet (selection of a normal paper sheet and a split seal paper sheet, for example), the print length, setting of right and left and upper and lower margins, setting of the number of copies to be printed, and setting of color/monochrome printing. The program proceeds to processing for doing printing. In the processing for doing printing, the presence or absence of a paper sheet and the type of an ink ribbon are first judged (step 2). The judgment of the presence or absence of the paper sheet can be made by a paper sheet detecting sensor (not shown). Further, in the judgment of the type of the ink ribbon, it can be judged whether the ink ribbon is monochrome or color, because there is a mark for judgment in the boundary between colors in the color ink ribbon, by judging the presence or absence of the mark.

When it is judged that the result of the judgment is not good, data representing a message that the designated paper sheet or ink ribbon should be set is produced, and the message is displayed by the display means 32 (step 3). When the result of the judgment is good, the paper sheet is conveyed to the position where the formation of an image is started (step 4). It is judged whether an image to be printed is a normal image or a split image (an image produced for split seals) (step 5). When the image is a normal image, normal printing is done (step 9). On the other hand, when the image is a split image, it is judged whether the printing form is the form shown in FIG. 4 or the form shown in FIGS. 5 and 6 (step 6). The judgment can be made by paper setting and mode setting depending on the user setting inputted in the step 1.

In the case of the form shown in FIG. 4, the split seal paper sheet is so conveyed that the line feed width A=the print width B, and printing data based on the split image is fed to the serial head 4, to form the split image (step 7). On the other hand, in the case of the form shown in FIGS. 5 and 6, the split seal paper sheet is so conveyed that the line feed width A>the print width B, and printing data based on the split image is fed to the serial head 4, to form the split image (step 8).

In the printing using the split seal paper sheet, when the paper sheet is conveyed to the position where image formation is started, and every time line feed is thereafter performed, the split seals 20 are so positioned as not to protrude into one scanning region of the serial head 4. The split seals 20 are subjected to serial head scanning once (in a case of monochrome image), or is subjected to serial head scanning three times for respective colors, that is, Y, M, and C (in a case of color image) (the paper sheet is not moved during the scanning). Therefore, the entire image on the split seal 20 can be formed without performing line feed.

In printing using such a split seal paper sheet, therefore, the entire image on one split seal 20 (corresponding to one line) can be formed without performing line feed. Even if non-uniformity of a pitch between lines occurs in the conveyance of the paper sheet, therefore, the effect of the non-uniformity in the pitch, that is, overlapping of pixels and a clearance between pixels does not occur in the formation of the image on the split seal, so that the image is not degraded.

The amount of conveyance (the amount of line feed) of the split seal paper sheet may be set by a user during paper setting and mode setting or by the printing apparatus upon obtaining required information from the split seal paper sheet. As the above-mentioned required information, a seal split position instructing mark is considered. It is considered that the mark is printed on a predetermined position of the split seal paper sheet. Specifically, the seal split position instructing mark is printed in the position of a portion which is not a seal (a layout sheet portion) corresponding to each step of the split seal and in a position corresponding to the home position of the carriage 5. The carriage 5 is provided with a sensor for detecting the mark. The entire control section 30 stops the feeding of pulses to the driving pulse motor in order to stop the conveyance of the split seal paper sheet when it receives information representing mark detection from the sensor. In the stopped state, the split seals 20 may be so positioned as not to protrude into one scanning region of the serial head 4.

As described in the foregoing, according to the present invention, there exists no gap due to line feed in an image on the split seal even if there is non-uniformity in conveyance, whereby the quality of the image can be increased.

(Second Embodiment)

Figure 11:
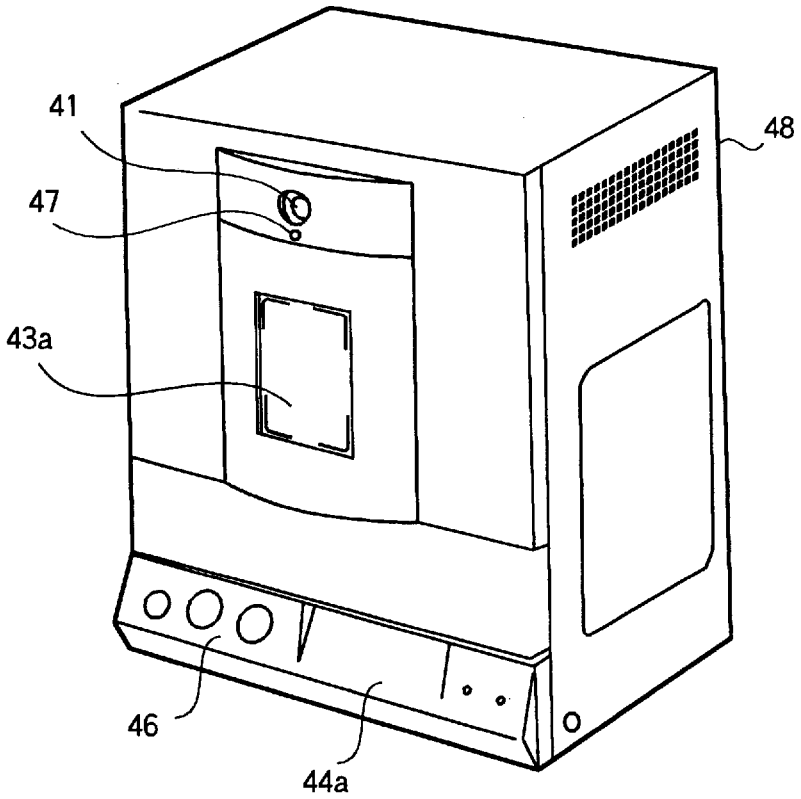
FIG. 11 is a perspective view showing the appearance of a photo seal printing apparatus to which the printing apparatus according to the present invention is applied.
Figure 12:
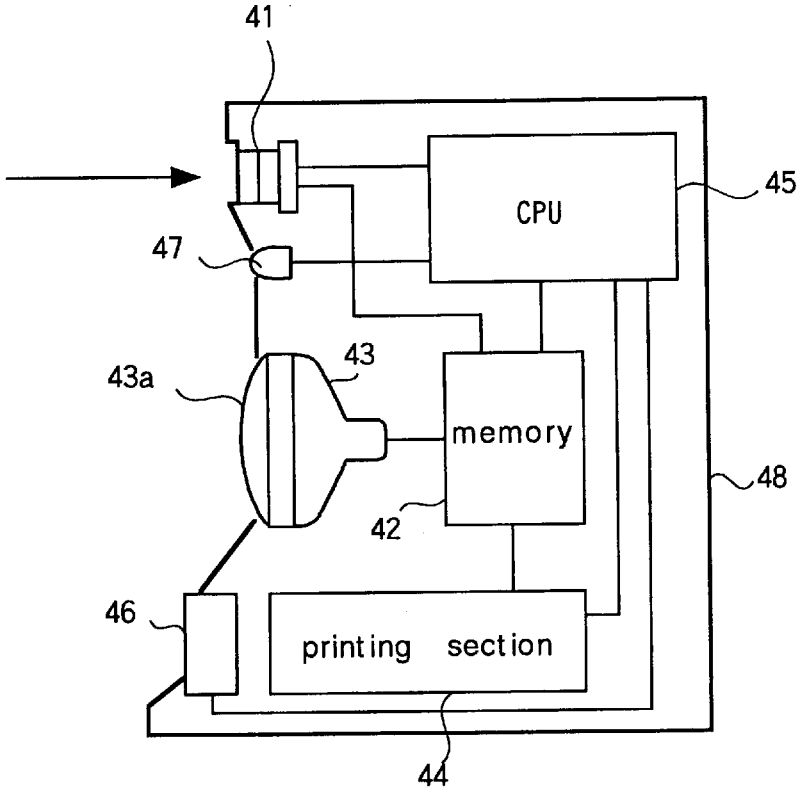
FIG. 12 is a diagram showing the schematic construction of the photo seal printing apparatus shown in FIG. 11.

FIG. 11 is a diagram showing the appearance of a photo seal printing apparatus using the printing apparatus according to the present invention, and FIG. 12 is a diagram showing the schematic construction thereof. The correspondence between FIG. 12 and FIG. 7 will be described. A CPU 45 corresponds to the entire control section 30, a camera 41 and an operation panel 46 correspond to the input means 31, a display 43 corresponds to the display means 32, a memory 42 corresponds to the work buffer 33 and the storage means 34, and a printing section 44 corresponds to the printing control section 35 and the printing mechanism shown in FIGS. 1 to 3.

In the present embodiment, the camera 41 comprises a color CCD (Charge Coupled Device), so that a color image is picked up. The memory 42 stores data such as an image (image data) picked up by the camera 41. The display 43 color-displays the image picked up by the camera 41, has a display screen 43*a* of 6-inch size in the present embodiment, and is composed of a CRT (Cathode-ray Tube) or a liquid crystal display panel. The CPU 45 carries out entire control of the photo seal printing apparatus. An operation panel 46 is one for receiving instructions to fix (determine) an image to be printed and do printing, for example, from a user, and gives the received instructions to the CPU 45. An LED 47 performs an on-off operation upon being controlled by the CPU 45. A cabinet 48 forms the external shape of the photo seal printing apparatus.

An image pickup lens portion of the camera 41, the display screen 43*a* of the display 43, the LED 47, the operation panel 46, and a discharge port 44*a* are positioned on the front side of the cabinet 48. The LED 47 is positioned in the vicinity of the camera 41 (between the display screen 43*a* and the camera 41 in the drawings), and the discharge port 44*a* is positioned below the display screen 43*a*. From the discharge port 44*a*, a split seal paper sheet on which printing has been done in the printing section 44 is being discharged.

In the above-mentioned photo seal printing apparatus, images picked up by the camera 41 are successively written to the memory 42 before the image to be printed is fixed, and the images successively written are successively read out from the memory 42, whereby a moving image is displayed on the display screen 43*a* of the display 43. Further, the LED 47 is driven upon being turned on and off by the CPU 45 until the image to be printed is fixed (while the moving image is being displayed).

When an image of a satisfactory expression is displayed, the user operates an image fixing instructing switch (not shown) provided in the operation panel 46 to instruct the CPU 45 to fix the image. Consequently, the image data stored in the memory 42 at the time point is fixed (new writing of the image data from the camera 41 in the memory 42 is inhibited) by the CPU 45, and the fixed image, that is, a still image is displayed on the display 43. Further, the on-off operation of the LED 47 is stopped by the CPU 45, so that the LED 47 is turned off.

When the fixed image is not satisfactory, the user operates a fixing release instructing switch (not shown) provided in the operation panel 46 to instruct the CPU 45 to release the fixing of the image. Consequently, the writing of the image data from the camera 41 in the memory 42 is resumed by the CPU 45. Therefore, the moving image is displayed on the display 43 for reading out the image data in the memory 42 and displaying the image data. Further, the LED 47 resumes the on-off operation by the CPU 45.

When the still image displayed on the display 43 is printed, the user operates a printing instructing switch (not shown) provided in the operation panel 46 to instruct the CPU 45 to do printing. Consequently, the image data stored in the memory 42 is fed to the printing section 44 by the CPU 45. The printing section 44 produces printing data on the basis of the fed image data, to print an image on the split seal paper sheet. At this time, the line feed width is controlled depending on the printing mode shown in FIG. 4 or 5, and the serial head is scanned in the direction in which the split seals in each line are arranged every time line feed is performed. When printing is done on all the split seals composing the split seal paper sheet, the split seal paper sheet is discharged from the discharge port 44*a*.

When the printing processing performed by the printing section 44 is terminated, the state of the photo seal printing apparatus is returned to a state before the instruction to fix the image by the image fixing instructing switch by the CPU 45. That is, processing for writing the image data from the camera 41 in the memory 42 is resumed, the moving image is displayed on the display 43, and the LED 47 is driven upon being turned on and off.

In the above-mentioned example, the same image is printed on all the split seals composing the split seal paper sheet. We have considered a printing mode in which an image to be printed is changed for each line feed (for each line) in addition to such a printing mode in which the same image is printed. Description is now made of the printing mode in which an image is changed. Both the modes are switched in a mode changing switch (not shown) provided in the operation panel 46, for example.

Also in the printing mode in which an image is changed, the fixing instructing switch provided in the operation panel 46 is operated from a state where the moving image is displayed, to instruct the CPU 45 to fix the image, to the above-mentioned mode in which the same image is printed. Consequently, the change of the image data stored in the memory 42 at the time point is inhibited by the CPU 45, so that the fixed image, that is, the still image is displayed on the display 43. Further, the on-off operation of the LED 47 is stopped by the CPU 45, so that the LED 47 is turned off.

Thereafter, when the CPU 45 is instructed to do printing by the printing instructing switch provided in the operation panel 46, the image data stored in the memory 42 is fed to the printing section 44 by the CPU 45. The printing section 44 produces printing data on the basis of the fed image data, and does printing on only the split seals corresponding to one line (one step) of the split seal paper sheet. Consequently, the same image is printed on the split seals corresponding to one line. The paper sheet is conveyed (line feed is performed) by one line in accordance with the printing mode shown in FIG. 4 or 5.

When printing corresponding to one line is terminated, processing for writing the image data from the camera 41 to the memory 42 is resumed by the CPU 45, the moving image is displayed on the display 43, so that the LED 47 is driven upon being turned on and off. Thereafter, processing of fixing of an image, printing of one line, and display of the moving image is repeated.

Figure 13:
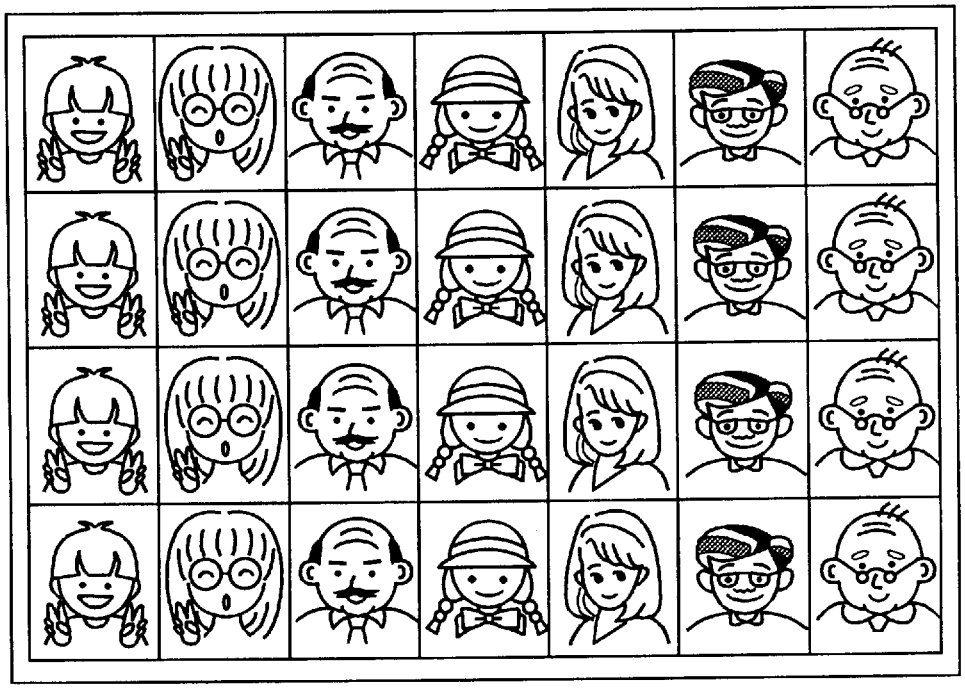
FIG. 13 is a diagram showing the printed state of a split seal paper sheet printed by the photo seal printing apparatus shown in FIG. 11.

The CPU 45 counts the number of lines to be printed on the split seal paper sheet. If the number of lines to be printed reaches a predetermined number of lines (the number of lines of split seals composing one split seal paper sheet), or if it is judged that the fixing release instructing switch provided in the operation panel 46 is continuously depressed for not less than a predetermined time period, for example, the split seal paper sheet on which the image has been printed by the printing section 44 is discharged from the discharge port 44*a*. The printed state of the split seal paper sheet in a case where the printing is thus done is as shown in FIG. 13.

As described in the foregoing, the split seals on which various types of images have been printed can be produced in one split seal paper sheet by changing an image to be printed for each line feed (for each line), and the quality of the image on each of the split seals can be increased by eliminating a gap caused by the line feed.

When a large capacity memory is used as the above-mentioned memory 42, another control method can be realized. Specifically, the memory 42 is provided with first to n-th regions so that n (n is an integer of not less than two) image data can be stored. Every time the image fixing instructing switch is operated, the image data are successively stored in the first region, the second region, . . . , the n-th region in this order. The image data stored in such a region need not be used for display, whereby the memory capacity may be prevented from being increased by subjecting the image data to reduction processing. The CPU 45 counts the number of times of image fixing processing. When the number of times of the image fixing processing reaches n, the program proceeds to printing processing without accepting an operation of the image fixing instructing switch. It is possible to do continuous printing with respect to a total of n split seal paper sheets by first doing printing on all the split seals composing the split seal paper sheet using the image data stored in the first region and doing printing on all split seals composing the subsequent split seal paper sheet using the image data stored in the second region.

In an example of the control using the large-capacity memory, the same image is printed on all the split seals composing the split seal paper sheet. It is possible to also realize the printing mode in which an image is changed using the large-capacity memory. Description is now made of the mode. For example, when a split seal paper sheet in which the number of lines of the split seals composing the split seal paper sheet is n is used as the split seal paper sheet, the memory 42 is provided with the first to the n-th regions so that n (n is an integer of not less than two) image data can be stored. Every time the image fixing instructing switch is operated, the image data are successively stored in the first region, the second region, . . . , the n-th region in this order. The CPU 45 counts the number of times of image fixing processing. When the number of times of the processing is n, the program proceeds to printing processing without accepting an operation of the image fixing instructing switch. Printing is done in such a manner that the image data stored in the first region is used with respect to the split seals in the first line, the image data stored in the second region is used with respect to the split seals in the second line, and the image data stored in the n-th region is used with respect to split seals in the n-th line. Consequently, the same split seal paper sheet which has been printed as that shown in FIG. 13 is obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing method using a split seal paper sheet, wherein a split seal paper sheet in which the width of split seals composing the split seal paper sheet in the direction of conveyance of the paper sheet is smaller than the print width of a serial head is used, one or more of said split seals is/are positioned in one scanning region of said serial head, to print an image on the split seals, and line feed for printing on one or more split seals in the subsequent line is performed in such a manner that the line feed width is the same as the print width of the serial head.

2. The printing method according to claim 1, wherein an image different from that before the line feed is printed in the printing on the split seal in the subsequent line.

3. A printing method using a split seal paper sheet, wherein a split seal paper sheet in which the width of split seals composing the split seal paper sheet in the direction of conveyance of the paper sheet is smaller than the print width of a serial head is used, one or more of said split seals is/are positioned in one scanning region of said serial head, to print an image on the split seals, and line feed for printing on one or more split seals in the subsequent line is performed in such a manner that the line feed width is larger than the print width of the serial head.

4. The printing method according to claim 3, wherein an image different from that before the line feed is printed in the printing on the split seal in the subsequent line.

5. A printing apparatus using a split seal paper sheet, comprising:

a paper conveying roller section for conveying a paper sheet;

line feed width control means for controlling the amount of feed of the paper sheet by the paper conveying roller section; and a serial head for doing printing on the paper sheet, wherein in a case where a split seal paper sheet in which the width of split seals composing the split seal paper sheet in the direction of conveyance of the paper sheet is smaller than the print width of the serial head is used as said paper sheet, one or more of said split seals is/are positioned in one scanning region of said serial head, to print an image on the split seals, and said line feed width control means performs line feed for printing on one or more split seals in the subsequent line in such a manner that the line feed width is the same as the print width of the serial head.

6. The printing apparatus according to claim 5, further comprising image pickup means, storage means in which image data outputted from said image pickup means is written, display means for reading out the image data from said storage means and displaying a image, image selection means for stopping the writing of new image data in said storage means, and printing data feeding means for feeding the image data stored in said storage means after the stop of the writing as printing data to the serial head.

7. The printing apparatus according to claim 6, further comprising control means for carrying out such control as to do printing on all the split seals composing the split seal paper sheet, and then resume the writing of new image data in said storage means.

8. The printing apparatus according to claim 6, further comprising control means for carrying out such control as to do printing with respect to lines whose number is smaller than the number of lines of the split seals composing the split seal paper sheet, and then resume the writing of new image data in said storage means, wherein an image different from that before the line feed is printed in printing on one or more split seals in the subsequent line.

9. The printing apparatus according to claim 6, wherein said storage means has first to n-th regions in which n (n is an integer of not less than two) image data can be stored, said image selection means is so constructed that the writing of new image data is stopped with respect to each of the first to n-th regions, and said printing data feeding means is so constructed that the image data stored in the first to n-th regions after the stop of the writing are fed as printing data to the serial head, further comprising control means for carrying out such control as to do printing on all the split seals composing the split seal paper sheet using the image data stored in an arbitrary region and do printing, with respect to the subsequent split seal paper sheet, on all split seals composing the split seal paper sheet using the image data stored in the other region.

10. The printing apparatus according to claim 6, wherein said storage means has first to n-th regions in which n (n is an integer of not less than two) image data can be stored, said image selection means is so constructed that the writing of new image data is stopped with respect to each of the first to n-th regions, and said printing data feeding means is so constructed that the image data stored in the first to n-th regions after the stop of the writing are fed as printing data to the serial head, further comprising control means for carrying out such control as to do printing using the image data stored in an arbitrary region with respect to lines whose number is smaller than the number of lines of the split seals composing the split seal paper sheet, and then do printing on one or more split seals in the subsequent line using the image data stored in the other region.

11. A printing apparatus using a split seal paper sheet, comprising a paper conveying roller section for conveying a paper sheet;

line feed width control means for controlling the amount of feed of the paper sheet by the paper conveying roller section; and a serial head for doing printing on the paper sheet, wherein in a case where a split seal paper sheet in which the width of split seals composing the split seal paper sheet in the direction of conveyance of the paper sheet is smaller than the print width of the serial head is used as said paper sheet, one or more of said split seals is/are positioned in one scanning region of said serial head, to print an image on the split seals, and said line feed width control means performs line feed for printing on one or more split seals in the subsequent line in such a manner that the line feed width is larger than the print width of the serial head.

12. The printing apparatus according to claim 11, further comprising image pickup means, storage means in which image data outputted from said image pickup means is written, display means for reading out the image data from said storage means and displaying the image data read out, image selection means for stopping the writing of new image data in said storage means, and printing data feeding means for feeding the image data stored in said storage means after the stop of the writing as printing data to the serial head.

13. The printing apparatus according to claim 11, further comprising control means for carrying out such control as to do printing on all the split seals composing the split seal paper sheet, and then resume the writing of the new image data in said storage means.

14. The printing apparatus according to claim 11, further comprising control means for carrying out such control as to do printing with respect to lines whose number is smaller than the number of lines of the split seals composing the split seal paper sheet, and then resume the writing of new image data in said storage means, wherein an image different from that before the line feed is printed in printing on one or more split seals in the subsequent line.

15. The printing apparatus according to claim 11, wherein said storage means has first to n-th regions in which n (n is an integer of not less than two) image data can be stored, said image selection means is so constructed that the writing of new image data is stopped with respect to each of the first to n-th regions, and said printing data feeding means is so constructed that the image data stored in the first to n-th regions after the stop of the writing are fed as printing data to the serial head, further comprising control means for carrying out such control as to do printing on all the split seals composing the split seal paper sheet using the image data stored in an arbitrary region and do printing, with respect to the subsequent split seal paper sheet, on all split seals composing the split seal paper sheet using the image data stored in the other region.

16. The printing apparatus according to claim 11, wherein said storage means has first to n-th regions in which n (n is an integer of not less than two) image data can be stored, said image selection means is so constructed that the writing of new image data is stopped with respect to each of the first to n-th regions, and said printing data feeding means is so constructed that the image data stored in the first to n-th regions after the stop of the writing are fed as printing data to the serial head, further comprising control means for carrying out such control as to do printing using the image data stored in an arbitrary region with respect to lines whose number is smaller than the number of lines of the split seals composing the split seal paper sheet, and then do printing on one or more split seals in the subsequent line using the image data stored in the other region.

* * * * *